US007708605B2

(12) United States Patent
Shibata et al.

(10) Patent No.: US 7,708,605 B2
(45) Date of Patent: May 4, 2010

(54) CONNECTOR WITH TERMINAL FITTINGS PRESS FIT IN A BASE WALL OF A CONNECTOR HOUSING

(75) Inventors: Takahiro Shibata, Yokkaichi (JP); Tsutomu Tanaka, Yokkaichi (JP); Yasuo Matsushita, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/166,441

(22) Filed: Jul. 2, 2008

(65) Prior Publication Data

US 2009/0011658 A1 Jan. 8, 2009

(30) Foreign Application Priority Data

Jul. 4, 2007 (JP) ..... 2007-175765

(51) Int. Cl.
*H01R 13/40* (2006.01)

(52) U.S. Cl. ..... 439/733.1; 439/751; 439/869

(58) Field of Classification Search ..... 439/736, 439/733.1, 740, 744, 751, 82
See application file for complete search history.

(56) References Cited

U.S. PATENT DOCUMENTS

| | | | | |
|---|---|---|---|---|
| 4,457,573 | A * | 7/1984 | Bailey et al. | 439/557 |
| 5,489,221 | A | 2/1996 | Fujiura et al. | |
| 6,851,976 | B2 * | 2/2005 | Ichida et al. | 439/595 |
| 7,037,146 | B2 * | 5/2006 | Nakamura | 439/751 |
| 7,175,480 | B2 | 2/2007 | Yamashita | |
| 7,179,123 | B2 | 2/2007 | Ohara | |
| 2004/0180582 | A1 | 9/2004 | Nakamura | |
| 2005/0159038 | A1 | 7/2005 | Tsuchiya | |
| 2005/0277341 | A1 | 12/2005 | Noguchi | |

FOREIGN PATENT DOCUMENTS

JP 2006-019228 1/2006

* cited by examiner

*Primary Examiner*—Michael C Zarroli
(74) *Attorney, Agent, or Firm*—Gerald E. Hespos; Michael J. Porco

(57) ABSTRACT

A base wall (21) of a connector housing (20) is formed with through holes (25), into which terminal fittings (60) are insertable. The inner surface of each through hole (25) includes an inclined portion (26) narrowed toward the rear side from the front surface of the base wall (21) and arranged at a position corresponding to projections (71) for guiding the terminal fitting (60), a straight portion (28) located behind the inclined portion (26), extending in an inserting direction toward the rear surface of the base wall (21) and having a press-in area for press-in portions (67), and restricting portions (27) defining steps together with the straight portion (28), extending from a taper end of the inclined portion (26) to the steps (35) and tightly holding rear parts of the projections (71) while preventing loose movements.

19 Claims, 6 Drawing Sheets

CONNECTOR WITH TERMINAL FITTINGS PRESS FIT IN A BASE WALL OF A CONNECTOR HOUSING

BACKGROUND OF THE INVENTION

1. Field of the Invention

The invention relates to a connector.

2. Description of the Related Art

Japanese Unexamined Patent Publication No. 2006-19228 relates to a circuit board connector with a housing. Through holes penetrate a base wall of the housing in a thickness direction and long narrow terminal fittings are inserted through the base wall. Each terminal fitting includes a press-in portion to be pressed into the through hole and a projection that projects out in width direction behind the press-in portion for limiting the penetration of the terminal fitting. Press-in areas are formed in middle parts of the through holes in forward and backward directions and receive the press-in portions of the terminal fittings. Recesses are formed in rear parts of the through holes. Front ends of the recesses and the rear ends of the press-in areas are connected via steps. Further, each recess has an inclined portion narrowed in an inserting direction of the terminal fitting from the rear end of the base wall for guiding the insertion of the terminal fitting.

The projections fit loosely in the recesses due to the presence of the inclined portions. Thus, a force for holding the terminal fitting in the base wall depends on the size of pressing margins of the press-in portions engageable with the press-in areas of the through holes. However, if the pressing margins are large, the insertion resistance of the terminal fittings increases to worsen operability. If the pressing margins are small, the terminal fittings are likely to misalign.

The invention was developed in view of the above situation and an object thereof is to reduce insertion forces for a terminal fitting and adjusting the alignment of the terminal fitting.

SUMMARY OF THE INVENTION

The invention relates a connector with a housing with a base wall and through holes that penetrate the base wall in a thickness direction. Terminal fittings are insertable into the through holes. Each terminal fitting is long and narrow, and has at least one projection projecting out in a width direction. At least one press-in portion is located before the projection with respect to an inserting direction and is pressed into a space defined by the inner surface of the through hole. At least one inclination is formed on the inner surface of each through hole and is narrowed towards the front with respect to the inserting direction of the terminal fitting from one end surface of the base wall. The inclination is at a position corresponding to the projection for guiding the terminal fitting. At least one substantially straight portion is located before the inclination with respect to the inserting direction of the terminal fitting and extends in the inserting direction towards the other end surface of the base wall. The straight portion has at least one press-in area for the press-in portion. At least one restriction defines at least one step together with the substantially straight portion and extends from a taper end of the inclined portion to the step for tightly holding a front area of the projection with respect to the inserting direction while preventing loose movements of the projecting portion.

Front areas of the projections with respect to the inserting direction are held tightly by the restrictions of the through holes while having loose movements thereof prevented. Thus, the terminal fittings are positioned and aligned. Accordingly, the press-in portions do not require large press-in margins engageable with the press-in areas for alignment adjustment and inserting forces for the terminal fittings can be reduced.

Each restriction preferably tightly holds the front area of the corresponding projection with respect to the inserting direction in a pressed state. Thus, an external force is unlikely to shake the terminal fitting.

The substantially straight portion of each through hole preferably includes at least one recess that does not contact a plate surface of the facing terminal fitting. Thus, the inserting force for the terminal fitting is reduced even further, and abrasion related damage on the plate surface of the terminal fitting is prevented.

The terminal fitting preferably is aligned by the restriction.

A main portion of the terminal fitting preferably passes the straight portion of the through hole without contact during insertion of the terminal fitting.

The restriction preferably positions the projection of the terminal fitting substantially towards the center of the through hole, and preferably is formed by three mutually orthogonal surfaces for restraining the widthwise outer end of the projection in a thickness direction.

The projections preferably are substantially rectangular and are arranged at opposite lateral edges of the main portion. The projections preferably project farther from the lateral edges of the main portion than the press-in portions.

Two press-in portions preferably are spaced apart in the inserting direction.

A preceding press-in portion in the inserting direction preferably has a shorter projecting distance than a succeeding press-in portion.

A slanted edge of the preceding press-in portion preferably is connected to a tip via a curve or non-linear portion and a slanted edge of the succeeding press-in portion preferably is connected to a tip via an angle.

The press-in portion preferably contacts a lateral surface of the through hole in such a manner to bite therein.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to a first embodiment of the invention is described with reference to FIGS. 1 to 6. The connector has a housing 20 and terminal fittings 60, and is connectable with a mating connector (not shown) while being mounted on a circuit board 90. In the following description, and end that is to be connected with the mating connector is referred to as the front end.

Figure 1:
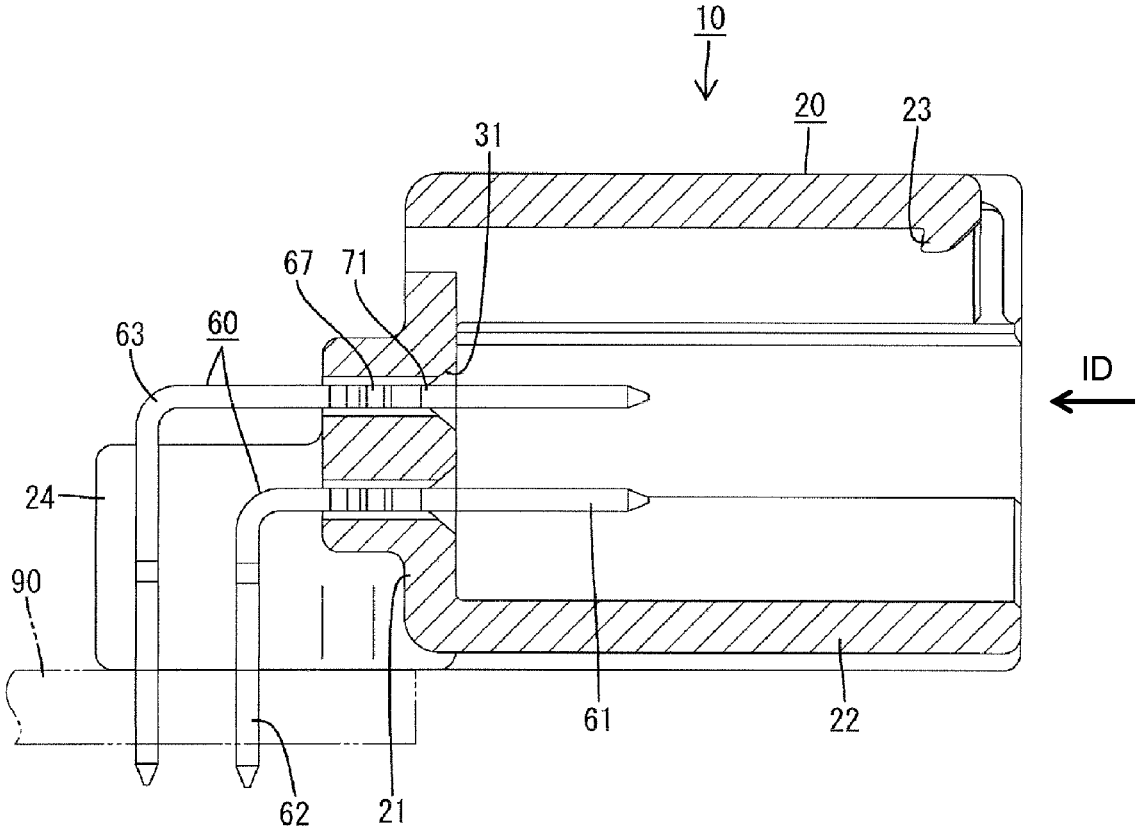
FIG. 1 is a side view of terminal fittings in a housing of a first embodiment.

Each terminal fitting 60 is formed unitarily by press-working an electrically conductive (preferably metal) plate and has a long, narrow, flat rectangular tab. As shown in FIG. 1, a terminal connecting portion 61 is defined at one end of the terminal fitting 60 and is configured to be connected with a mating terminal fitting. A board connecting portion 62 is formed at the opposite end of the terminal fitting 60 and is to be passed through a through hole of the circuit board 90. The leading ends of the terminal connecting portion 61 and the board connecting portion 62 are tapered for guiding purposes. This connector 10 includes small and large terminal fittings 60 with different plate widths.

Figure 2:
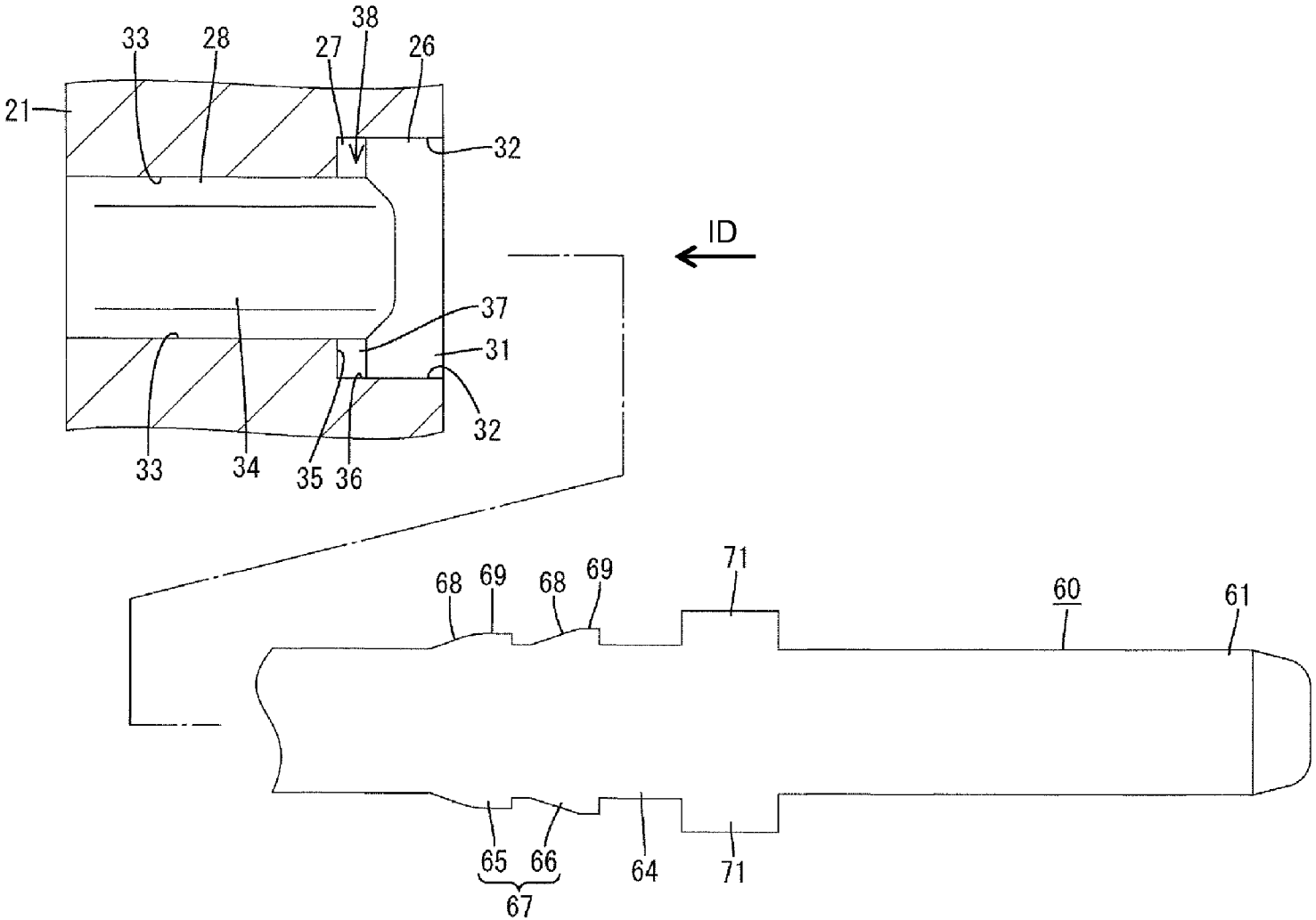
FIG. 2 is a partial enlarged plan view of the terminal fitting before being inserted into a through hole of a base wall.

The terminal fitting 60 is press fit into a base wall 21 of the housing 20 from the front and, after the insertion, the board connecting portion 62 projecting back from the rear of the housing 20 is bent at a substantially right angle towards the circuit board 90 to form an L-shaped bend 63. As shown in FIG. 2, the terminal fitting 60 has a longitudinally extending main portion 64 between the bend 63 and the terminal connecting portion 61. The main portion 64 has the same width as the bend 63 and the terminal connecting portion 61 and is accommodated in the base wall 21 so that the thickness of the main portion 64 aligns with height of the housing 20.

Press-in portions 67 project laterally from the opposite sides of the main portion 64. The press-in portions 67 include a preceding press-in portion 65 disposed to be mounted first into the base wall 21 and a succeeding press-in portion 66 disposed to be mounted later into the base wall 21. The preceding press-in portion 65 preferably has a shorter projecting distance from the lateral edge of the main portion 64 than the succeeding press-in portion 66.

Each press-in portion 67 has a slanted edge 68 to gradually reduce the projecting distance toward the front with respect to the inserting direction ID. The slanted edge of the preceding press-in portion 65 is connected to a tip 69 via a smooth curved transition, whereas the slanted edge 68 of the succeeding press-in portion 66 is connected to a tip 69 via a non-smooth angled transition (i.e. the first derivative of the curve is non-continuous). The preceding press-in portions 65 are mounted smoothly into the base wall 21 because of their short projecting distance and the curved outer rear ends of the slanted edges 68. The succeeding press-in portions 66 are fixed strongly to the base wall 21 because of their longer projecting distance and the angled outer rear ends of the slanted edges 68.

Figure 3:
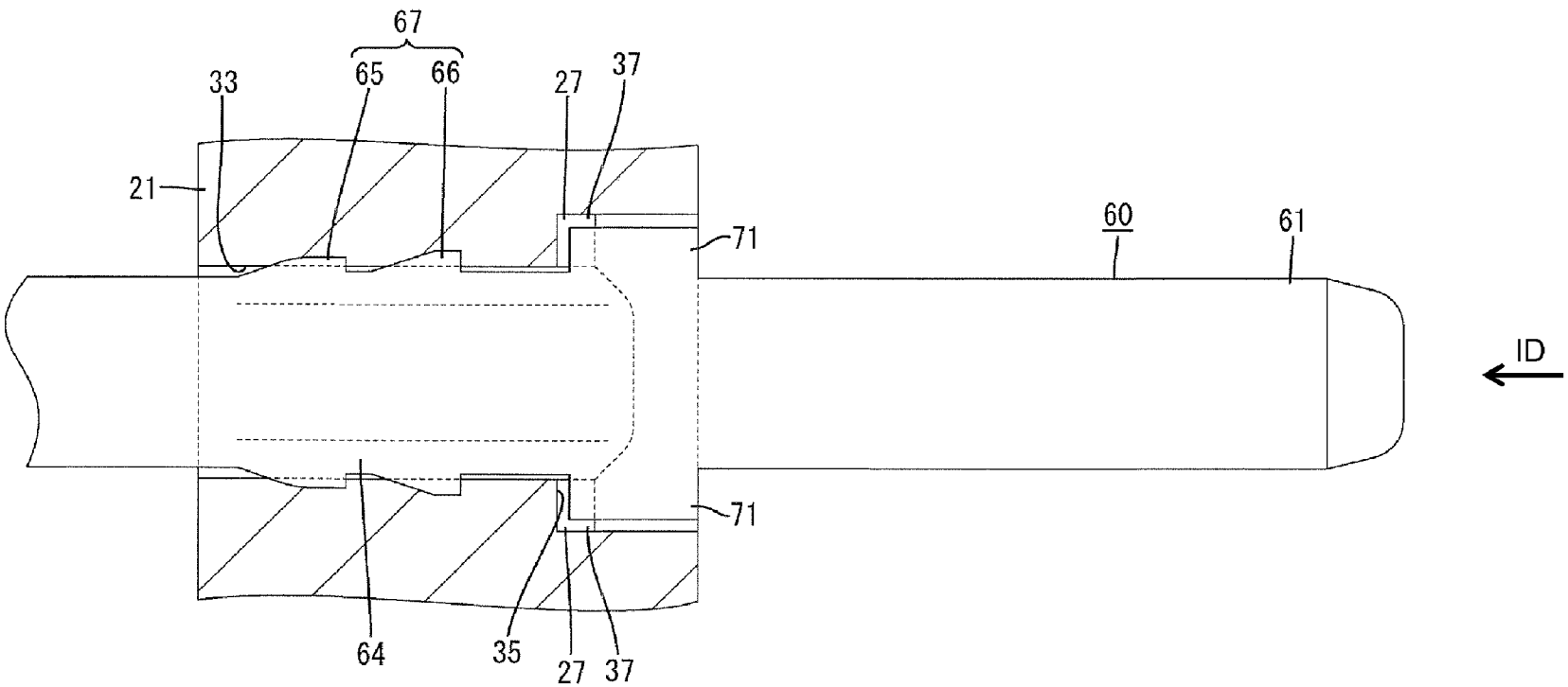
FIG. 3 is a partial enlarged plan view of the terminal fitting inserted into the through hole of the base wall.

The terminal fitting 60 also is formed with projections 71 projecting out in the width direction from the opposite lateral edges of the main portion 64 at a position behind the press-in portions 67 with respect to the inserting direction ID and towards the terminal connecting portion 61. The projections 71 are substantially rectangular and have a longer projecting distance from the lateral edges of the main portion 64 than the press-in portions 67. Thus, the terminal fitting 60 is wider at the projections 71. The projections 71, the press-in portions 67 and the main portion 64 have substantially the same thickness, and the projections 71 and the press-in portions 67 are transversely symmetrical with respect to the widthwise center of the main portion 64. FIGS. 1 to 3 show the large terminal fitting 60. The small terminal fittings 60 are narrower, but are shaped similarly.

The housing 20 is made e.g. of synthetic resin and includes a wide rectangular tubular receptacle 22 with an open front end, as shown in FIG. 1. The mating connector is fittable into the receptacle 22. A lock 23 for holding the mating connector connected projects in a widthwise intermediate position of the ceiling surface of the receptacle 22. Further, two mounting portions 24 project back at the opposite widthwise ends of the rear end of the receptacle 22 and are placeable on the upper surface of the circuit board 90. Round holes (not shown) are formed in the lower end surfaces of the mounting portions 24, and extend in the height direction. Tapping screws or the like can be tightened in these round holes from the side of the circuit board 90 to fix the connector 10 onto the circuit board 90.

Figure 5:
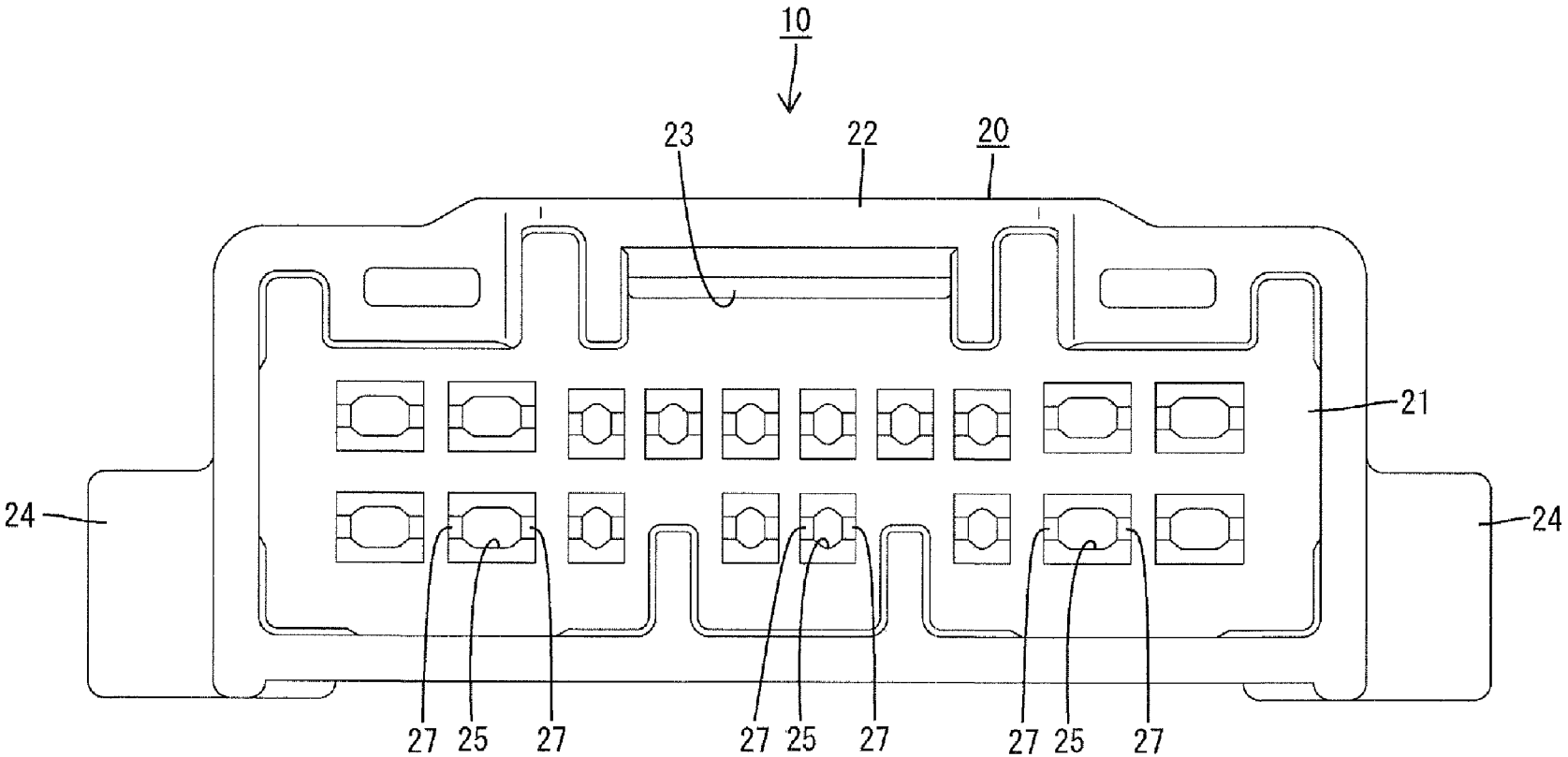
FIG. 5 is a front view of the housing before the terminal fittings are mounted.

A base wall 21 extends vertically in the height direction at the back of the receptacle 22. Through holes 25 are formed in upper and lower levels of the base wall 21, and the terminal fittings 60 are pressed through the through holes 25 and held therein. As shown in FIG. 5, the through holes 25 arrayed in a widthwise intermediate part of the housing 20 correspond to the small terminal fittings 60, whereas the through holes 25 arrayed at opposite widthwise sides of the housing 20 correspond to the large terminal fittings 60.

As shown in FIG. 2, the inner surface of each through hole 25 includes at least one incline 26, restrictions 27 and a straight portion 28 in this order from the front (rear with respect to the inserting direction ID of the terminal fitting 60).

Figure 4:
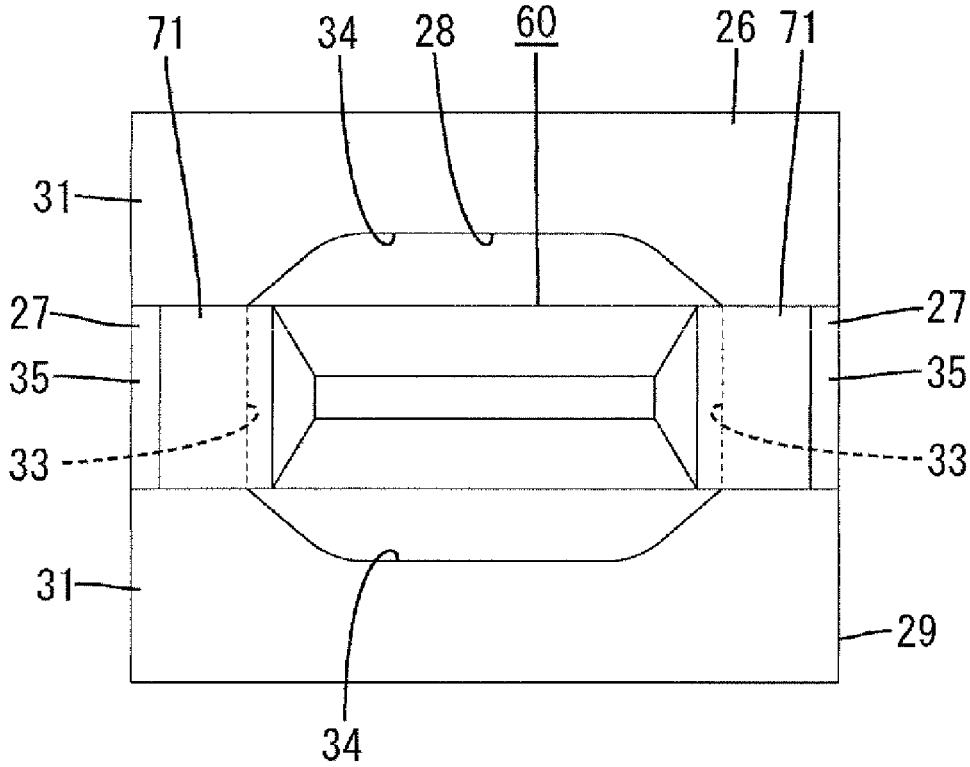
FIG. 4 is a partial enlarged front view of the terminal fitting inserted into the through hole of the base wall.

The incline 26 is widened gradually towards the front surface of the base wall 21 and guides the terminal fitting 60 towards the center of the through hole 25. More specifically, as shown in FIG. 4, the incline 26 has two slants 31 aligned to taper the through hole 25 from the front surface of the base wall 21 towards the rear surface of the base wall 21. The slants 31 form a substantially rectangular frame-like edge 29 at the front surface of the base wall 21, and the rear edges of the slants 31 are arranged substantially parallel in a vertical plane. The spacing between the rear edges of the slants 31 is substantially equal to the thickness of the projections 71, the press-in portions 67 and the main portion 64 of the terminal fitting 60. The incline 26 is at a position substantially corresponding to the projections 71 of the terminal fitting 60 so that the slants 31 cover the projections 71. Wall surfaces 32 extend substantially vertically at opposite widthwise ends of the incline 26.

The straight portion 28 extends substantially straight in forward and backward directions to the rear surface of the base wall 21. More particularly, the straight portion 28 is defined by left and right facing surfaces 33 for receiving the press-in portions 67 of the terminal fitting 60 and upper and lower facing surfaces 34 for facing the opposite plate surfaces of the main portion 64 of the terminal fitting 60. The upper and lower facing surfaces 34 of the straight portion 28 are at the same sides as the slants 31 of the incline 26 and the front ends thereof are substantially continuous with the tapered end of the incline 26. The upper and lower facing surfaces 34 of the straight portions 28 are recessed and are substantially vertically symmetrically so as not contact the entire plate surfaces of the main portion 64. Additionally, the facing surfaces 34 are mountain-shaped and concave in cross section so that parts of the facing surfaces 34 corresponding to widthwise intermediate parts of the plate surfaces of the main portion 64 are most distant from these plate surfaces.

The left and right facing surfaces 33 of the straight portion 28 include substantially vertically arranged press-in areas for engaging the press-in portions 67. The press-in areas of the left and right facing surfaces 33 are wider than the main portion 64 of the terminal fitting 60, but narrower than the press-in portions 67. Thus, the press-in portions 67 contact and bite into the left and right facing surfaces 33 for pushing the left and right facing surfaces 33 outwardly in the width direction. A retaining force for the terminal fitting 60 is increased by the biting engagement of both the preceding press-in portions 65 and succeeding press-in portions 66.

Figure 6:
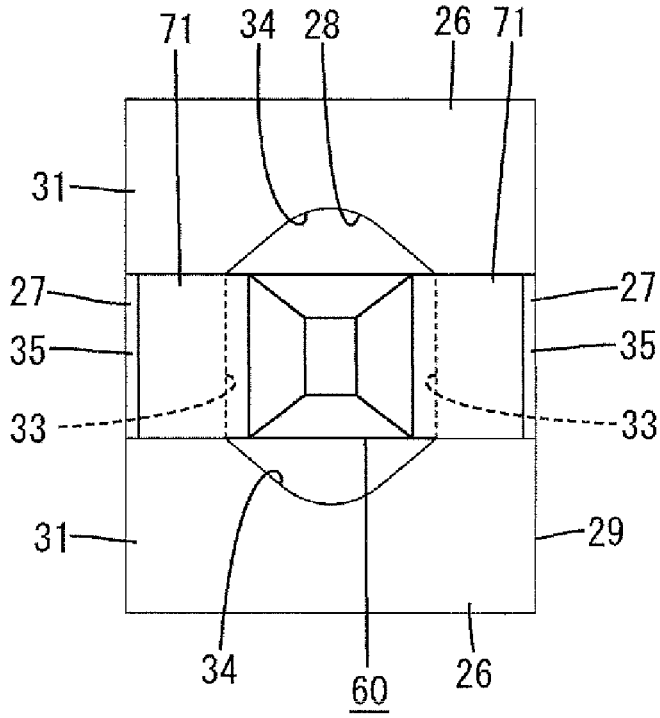
FIG. 6 is a partial enlarged front view of another terminal fitting inserted into a through hole of the base wall.

The restrictions 27 position the rear part of the projection 71 of the terminal fitting 60 towards the center of the through hole 25, and is formed by three mutually orthogonal surfaces for restraining the widthwise outer end of the rear part of the projection 71 in the thickness direction. The restrictions 27 are arranged between the incline 26 and the left and right facing surfaces 33 of the straight portion 28 and are at positions substantially continuous with the opposite widthwise ends of the taper of the incline 26. More specifically, each restriction 27 is substantially continuous with the left or right facing surface 33 of the straight portion 28 and includes a step 35, a lateral end surface 36 and upper and lower main surfaces 37. The step 35 faces the front end of the projection 71. The lateral end surface 36 is between the vertical wall 32 of the incline 26 and the step 35 and faces the widthwise outer edge of the rear part of the projection 71. The upper and lower main surfaces 37 are between the slants 31 of the incline 26 and the step 35 to sandwich the rear part of the projection 71 in the thickness direction. The main surfaces 37 of the restriction 27 are flat and extend substantially straight in a horizontal direction from the rear edges of the slants 31 of the incline 26 to the step 35. The spacing between the main surfaces 37 substantially equals the thickness of the projection 71. A positioning space 38 is defined by the main surfaces 37, the lateral end surface 36 and the step 35 for holding the rear part of the projection 71 and to prevent any loose movements. As shown in FIG. 6, the inner surface of the through hole 25 corresponding to the narrow terminal fitting 60 is formed similarly.

Upon mounting the terminal fitting 60 through the base wall 21, the board connecting portion 62 of the terminal fitting 60, prior to forming the bend 63, is oriented towards the front surface of the base wall 21 of the housing 20. The terminal fitting 60 then is inserted substantially horizontally in the inserting direction ID into the through hole 25 in this state. The incline 26 centers the board connecting portion 62 and corrects the inserting posture of the terminal fitting 60 during insertion of the terminal fitting 60 to ensure a smooth inserting operation. Further, the main portion 64 of the terminal fitting 60 passes the upper and lower facing surfaces 34 of the straight portion 28 of the through hole 25 without contact during insertion of the terminal fitting 60 so that no frictional resistance is produced.

The press-in portions 67 face the left and right facing surfaces 33 of the straight portion 28 when a final stage of the inserting operation is reached. Thus, the preceding press-in portions 65 and the succeeding press-in portions 66 are pressed successively into the press-in areas with the slanted edges 68 in the lead so as to bite in and engage the straight portion 28. Simultaneously, the projections 71 enter between the main surfaces 31 of the incline 26 and the rear parts of the projections 71 enter the positioning spaces 38 to be sandwiched in the thickness direction by the main surfaces 37 of the restrictions 27. The terminal fitting 60 is retained with the press-in portions 67 in an intermediate part of the straight portion 28 in forward and backward directions when the insertion is completed. The rear ends of the projections 71 face the steps 35 of the restrictions 27 to prevent the terminal fitting 60 from being pushed any further forward. Thus, the terminal fitting 60 is held centered and the restriction 27 prevents loose movements of the projections 71.

The terminal fittings 60 then are bent substantially perpendicularly down towards the circuit board 90 at intermediate positions to form the bends 63 so that the board connecting portions 62 extend down. The board connecting portions 62 then are inserted into the through holes of the circuit board 90 and are connected electrically with conductive paths of the circuit board 90 e.g. by soldering, welding, press-fitting, insulation displacement or the like. Further, the mating connector is fit into the receptacle 22 of the housing 20 to connect the terminal connecting portions 61 of the terminal fittings 60 with the respective mating terminal fittings.

As described above, front areas of the projections 71 with respect to the inserting direction ID are held by the restrictions 27 of the through holes 25 so as not to move loosely for positioning the terminal fittings 60. Thus, the terminal fittings 60 are aligned and centered, and it is not necessary to provide the press-in portions 67 with large press-in margins engageable with the press-in areas for alignment adjustment. Hence, the inserting forces for the terminal fittings 60 are low. Furthermore, the straight portions 28 of the through holes 25 include the recessed surfaces that do not contact the facing plate surfaces of the terminal fittings 60. Therefore, the insertion forces for the terminal fittings 60 are reduced further. Accordingly, abrasion and damage of the plate surfaces of the terminal fittings 60 is prevented and contact reliability is improved.

Figure 7:
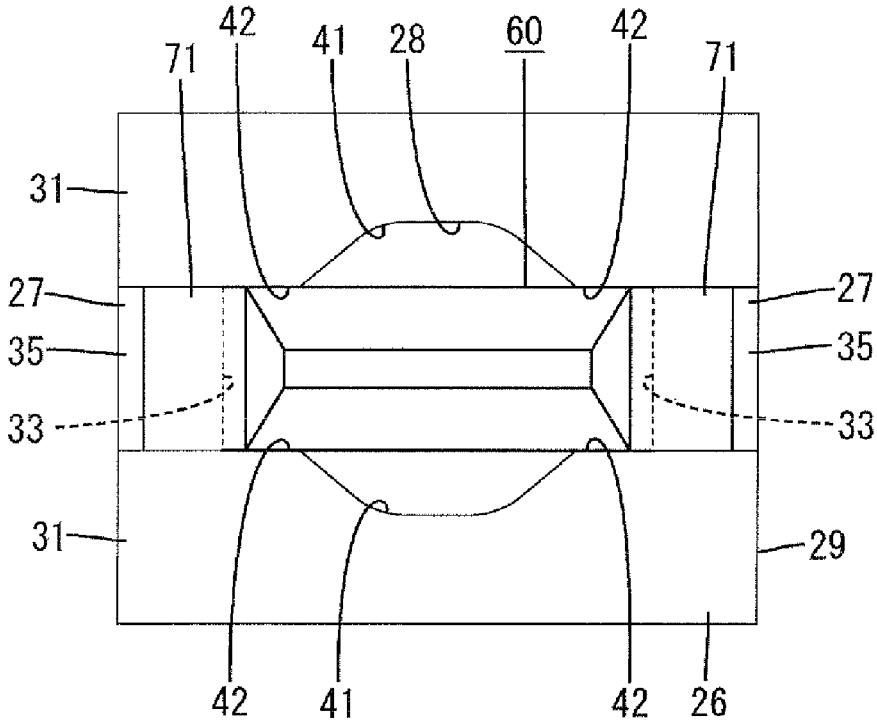
FIG. 7 is a partial enlarged front view of a terminal fitting inserted into a through hole of a base wall in a second embodiment.

FIG. 7 shows a second embodiment of the invention. The second embodiment has a base wall 21 with through holes 25 that have inner surfaces with a straight portion 28 configured differently than in the first embodiment. The straight portion 28 of the second embodiment includes recessed surfaces only in a widthwise intermediate part and differs from the straight portion 28 of the first embodiment that has the recessed surfaces over substantially the entire width.

The straight portion 28 has mountain-shaped concave recessed surfaces 41 distanced from widthwise intermediate parts of the plate surfaces of the main portion 64 so as not to contact these widthwise intermediate parts and substantially flat surfaces 42 to be achieve surface contact with the opposite widthwise sides of the plate surfaces of the main portion 64. The recessed surfaces 41 and the flat surfaces 42 are vertically symmetrical.

According to the second embodiment, the widthwise intermediate part of the main portion 64 of the terminal fitting 60 does not contact the recessed surfaces 41 of the straight portion 28 during insertion of the terminal fitting 60 into the through hole 25. Thus, an inserting force for the terminal fitting 60 is low. In addition, after the insertion of the terminal fitting 60 into the through hole 25, the opposite widthwise sides of the main portion 64 of the terminal fitting 60 are adjacent to the flat surfaces 42 of the straight portion 28 and are sandwiched by the flat surfaces 42 of the straight portion 28. Thus, the terminal fitting 60 is prevented from shaking even upon the action of an external force.

The invention is not limited to the above described and illustrated embodiments. For example, the following embodiments are also embraced by the technical scope of the present invention as defined by the claims.

The front areas of the projections with respect to the inserting direction may be held tightly in a pressed state by the restrictions. Then, the terminal fitting is prevented from shaking in an external force acting direction. In this case, the spacing between the main surfaces of the restrictions may be made narrower toward the front with respect to the inserting direction of the terminal fitting to become smaller than the thickness of the projections.

The terminal fittings may be inserted into the through holes of the base wall from behind.

Three or more press-in portions may be arranged substantially side by side on each lateral edge of the main portion of the terminal fitting.

The straight portion of the through hole may be brought substantially into surface contact with the entire plate surfaces of the facing terminal fitting.

The terminal fittings may be formed straight without being bent in an L-shape or may have any other configuration as needed.

What is claimed is:

1. A connector, comprising:

a housing with a receptacle having an open front end and a rear end, a base wall at least partly closing the rear end of the receptacle, the base wall having a first surface facing forwardly into the receptacle and a second surface facing rearwardly and substantially opposite the first surface, at least one through hole penetrating the base wall between the first and second surfaces, and at least one long narrow terminal fitting insertable into the through hole, the terminal fitting including at least one projection projecting out in a width direction and at least one press-in portion located before the projection with respect to an inserting direction and to be pressed into a space defined by an inner surface of the through hole, wherein the through hole has an inner surface that includes:

an inclined entry narrowed at farther distances from the first surface of the base wall and arranged at a position substantially corresponding to the projection for guiding the terminal fitting;

at least one substantially straight portion extending substantially in the inserting direction between the inclined entry and the second surface of the base wall, the straight portion having at least one press-in area for receiving the press-in portion; and at least one restriction defining at least one step together with the straight portion and extending from a tapered end of the inclined entry to the step, the restriction being dimensioned for tightly holding the projection and preventing loose movements of the projection.

2. The connector of claim 1, wherein the restriction tightly holds the front area of the corresponding projection (71) with respect to the inserting direction in a pressed state.

3. The connector of claim 1, wherein the substantially straight portion of the through hole includes at least one recessed surface (41) spaced from a plate surface of the facing terminal fitting.

4. The connector of claim 1, wherein the terminal fitting is aligned by the restriction.

5. The connector of claim 1, wherein during the insertion of the terminal fitting into the through hole, a main portion of the terminal fitting passes the straight portion of the through hole without touching.

6. The connector of claim 1, wherein the restriction positions the projection of the terminal fitting substantially towards the center of the through hole, and is formed by three mutually orthogonal surfaces for restraining the widthwise outer end of the projection in thickness direction.

7. The connector of claim 1, wherein two projections having a substantially rectangular shape are arranged at substantially opposite lateral edges of the main portion and have a longer projecting distance from the lateral edges of the main portion than the press-in portions.

8. The connector of claim 1, wherein two press-in portions are provided spaced apart in the inserting direction.

9. The connector of claim 8, wherein a preceding press-in portion in the inserting direction has a shorter projecting distance than a succeeding press-in portion in the inserting direction.

10. The connector of claim 9, wherein a slanted edge of the preceding press-in portion is connected to a tip via a curve and a slanted edge of the succeeding press-in portion is connected to a tip portion via an angle.

11. The connector of claim 1, wherein the press-in portion contacts a lateral surface of the through hole in a manner to bite therein.

12. A connector housing that has a receptacle with a forwardly open front end and a rear end, a base wall having a first surface facing forwardly and into the receptacle and a second surfaces opposite the first surface and facing substantially rearwardly on the housing, at least one through hole penetrating the base wall between the first and second surfaces, the through hole having an inner surface that comprises:

an inclined entry defined by two opposed slants extending from the first surface towards the second surface and approaching one another at farther distances from the first surface;

two opposed restrictions extending from the inclined entry towards the second surface, the restrictions being aligned substantially centrally between the slants, each of the restrictions including a step facing away from the second surface; and a substantially straight portion extending from a position between the slants and the restrictions to the second surface.

13. The connector housing of claim 12, wherein the straight portion has two opposed recessed surfaces extending from the slants to the second surface of the base wall.

14. The connector housing of claim 13, wherein the straight portion has two opposed parallel side surfaces, the recessed surfaces extending continuously between the side surfaces of the straight portion.

15. The connector housing of claim 13, wherein the straight portion has two opposed parallel side surfaces, the recessed surfaces being spaced inwardly from the side surfaces of the straight portion.

16. The connector housing of claim 12, wherein the restrictions each include a plurality of surfaces extending perpendicularly from the step to the incline.

17. A connector, comprising:

a long narrow terminal fitting with opposite first and second ends, at least one projection extending out in a width direction at a location between the ends and at least one press-in portion extending out in the width direction between the projection and the second end; and a housing that has a receptacle with a forwardly open front end and a rear end, a base wall having a first surface facing forwardly and into the receptacle and a second surfaces opposite the first surface and facing substantially rearwardly on the housing, at least one through hole penetrating the base wall between the first and second surfaces for receiving the terminal fitting, the through hole having an inner surface with an inclined entry defined by two opposed slants extending from the first surface towards the second surface and approaching one another at farther distances from the first surface, two opposed restrictions extending from the inclined entry towards the second surface, each of the restrictions including a step facing away from the second surface and dimensioned for engaging the projection to limit insertion of the terminal fitting, and a substantially straight portion extending to the second surface from a position between the slants and the restrictions, the straight portion being dimensioned to engage the press-in portion for holding the terminal fitting in the through hole.

18. The connector of claim 17, wherein the restrictions each include a plurality of surfaces extending perpendicularly from the step to the incline for engaging corresponding surfaces of the projection.

19. The connector of claim 17, wherein the straight portion has two opposed parallel side surfaces for engaging the press-in portions, two opposed recessed surfaces between the side surfaces and extending from the slants to the second surface of the base wall, the recessed surfaces being spaced from the terminal fitting.

* * * * *